US006171175B1

(12) United States Patent
Shaikh et al.

(10) Patent No.: US 6,171,175 B1
(45) Date of Patent: Jan. 9, 2001

(54) METHOD OF POLISHING UNIFORM OR FREE-FORM METAL SURFACES

(75) Inventors: Furqan Zafar Shaikh, Troy; Joseph Carl Schim, Saline; Christopher Stoll, Dearborn; Marc A. Walther, Macomb, all of MI (US); Paul Sasaki, Painsville, OH (US)

(73) Assignee: Ford Global Technologies, Inc., Dearborn, MI (US)

( * ) Notice: Under 35 U.S.C. 154(b), the term of this patent shall be extended for 0 days.

(21) Appl. No.: 09/209,836

(22) Filed: Dec. 11, 1998

(51) Int. Cl.[7] ..... B24B 49/00

(52) U.S. Cl. ..... 451/28; 451/466; 451/5; 451/913; 451/916; 451/11

(58) Field of Search ..... 451/466, 28, 1, 451/5, 11, 913, 916, 121; 15/21.1, 88.4, 179

(56) References Cited

U.S. PATENT DOCUMENTS

| | | | | |
|---|---|---|---|---|
| 1,652,834 | * | 12/1927 | Neufeld | 15/179 |
| 3,695,563 | * | 10/1972 | Rands | 451/466 |
| 4,555,229 | * | 11/1985 | Biadigo et al. | 451/121 |
| 4,882,879 | * | 11/1989 | Warner et al. | 451/466 |
| 4,945,687 | | 8/1990 | Scheider et al. . | |
| 5,355,639 | | 10/1994 | Ferard et al. . | |
| 5,443,413 | | 8/1995 | Pflager et al. . | |
| 5,895,311 | * | 4/1999 | Shiotani et al. | 451/5 |

FOREIGN PATENT DOCUMENTS

| | | | | |
|---|---|---|---|---|
| 353139789 | * | 11/1978 | (JP) | 451/28 |
| 403294165 | * | 12/1991 | (JP) | 451/413 |

* cited by examiner

*Primary Examiner*—David A. Scherbel
*Assistant Examiner*—George Nguyen
(74) *Attorney, Agent, or Firm*—Joseph W. Malleck

(57) ABSTRACT

Method of automatic finishing of a free-form contoured metal or hard die surface, comprising: providing a rotating brush with a central hub carried by a driving spindle for rotation about the hub axis; providing the brush hub with a plurality of closely spaced resilient and independently flexible strands possessing abrasive polishing particles, each strand being secured at one end in the hub and having its other end extending radially away therefrom to present an apparent curved surface of closely spaced strand ends (the series of touching or closely spaced strand ends forming at least a portion of a spherical surface); and rotatingly driving the hub and strands at a constant torque while dragging the ends of said strands across the die surface while in contact therewith to effect the desired degree of polishing. The coating of abrasive polishing particles can be selected from the group of aluminum oxide, silicon oxide or silicon carbide. The flexible strands are preferably formed of stabilized nylon filament.

8 Claims, 2 Drawing Sheets

METHOD OF POLISHING UNIFORM OR FREE-FORM METAL SURFACES

TECHNICAL FIELD

This invention relates to the technology of finishing metal surfaces, such as free-form surfaces presented by dies, and more particularly to the polishing of such surfaces to a precise contour devoid of overpolishing.

DISCUSSION OF THE PRIOR ART

One of the longest lead time programs needed for making part of a new automobile is that for making tooling for the part. Such tooling may include dies for body panels, dies for casting sand cores used to mold engine components, and die tooling for making injection molded plastic components, such as used in the interior of the vehicle. The basic shape of these dies or tooling is usually obtained by finish machining its free-form shape using a milling or other cutter that is moved back and forth along parallel paths with varying cutting depths according to a numerical control (a computer program that dictates the path of a machining bit to remove metal from a rough formed body). The numerically controlled upright milling cutter is governed to move along a two-dimensional path and is raised or lowered along its upright axis to achieve different depths of cutting. Such milled surface never can obtain an exact contour identical to the computer designed surface because the rotary milling head cutter can only approximate steep radiused contours leaving small corners to be polished away subsequently under manual guidance. Heretofore, manual polishing has involved use of abrasive powders and abrasive stones, commonly known as lapping compounds and polishing stones. The deficiencies of manual polishing is the tendency to remove an excessive amount of material losing the integrity of the surface, or the tendency to not remove sufficient material (underpolishing) which causes the surface to improperly function. Even the best experienced craftsman may hand-polish excessively in certain areas, thus achieving less than the desired mathematical shape and usually in an excessive period of time (such as 20–30% of the total machining time), thus making the process inefficient.

To overcome the difficulties of manual polishing, the prior art has attempted to use costly stoning mills to achieve the desired finish. This is disadvantageous because of the high capital cost, and because toolmakers are required to run and guide the machinery which may introduce error.

The prior art has also attempted to use programmable dexterous robots which tilt the milling cutter to more closely approximate the desired contours, which is then followed by robotic polishing using a similar tiltable axis. This technique suffers from a significant cost penalty, although it approaches more effectively the desired polished form.

And lastly, the prior art has attempted to modify the polishing tool in order to eliminate the need for expensive machinery. For example, in U.S. Pat. No. 4,945,687, a polishing brush was constructed having filaments joined together by foam containing encapsulated abrasive grit (the abrasive was not on the filaments directly). The foam inherently was weak and rapidly disintegrated during use, even though the filaments were initially strengthened by the foam. The brush required a continuous polishing face, as created by the continuous body of foam. Also in U.S. Pat. No 5,355,639, a rotary polishing tool, comprised of coated elastic plates, was used with the plates to act as resilient deflection springs. Such elastic plates were moved at a constant rotary speed to be able to machine plastic or other soft materials limiting the tool's use. Unfortunately, such tools are unable to achieve the desired results sought by this invention.

SUMMARY OF THE INVENTION

A primary object of this invention is provide a cost-effective process (capital cost not greater than $15,000) that can eliminate inaccuracies of polishing while doing so economically.

The method of this invention which meets the above object is a method of automatic finishing of a free-form contoured metal or hard die surface, comprising: providing a rotating brush with a central hub carried by a driving spindle for rotation about the hub axis; providing the brush hub with a plurality of closely spaced resilient and independently flexible strands impregnated with or coated with abrasive polishing particles, each strand being secured at one end in the hub and having its other end extending radially away therefrom to present an apparent curved surface of closely spaced strand ends (the series of touching or closely spaced strand ends forming at least a portion of surface); and rotatingly driving the hub and strands at a constant torque while dragging the ends of aid strands across the die surface while in contact therewith to effect the desired degree of polishing. The coating of abrasive polishing particles can be selected from the group of aluminum oxide, silicon oxide or silicon carbide. The flexible strands are preferably formed of stabilized nylon filament.

DETAILED DESCRIPTION AND BEST MODE

Figure 1:
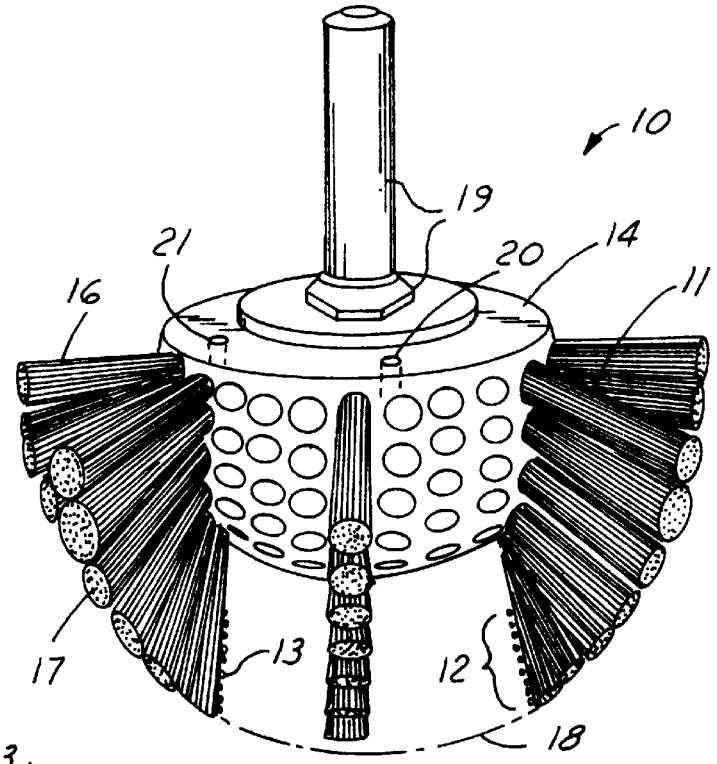
FIG. 1 is a perspective view of a polishing brush useful in carrying out the method of this invention.
Figure 2:
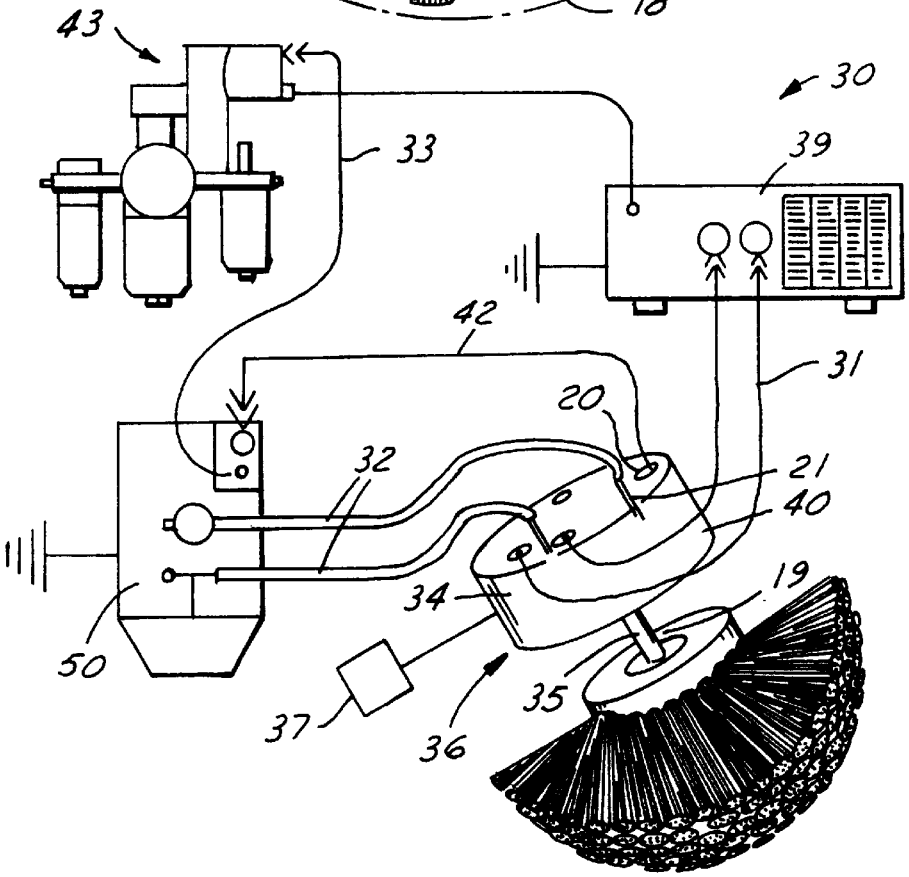
FIG. 2 is a schematic representation of preferred controls and apparatus for carrying out and controlling the movement of the brush of FIG. 1 when practicing the method herein.

The method requires provision of a unique rotating brush 10, as shown in FIG. 1, and provision of a unique control 30, as shown in FIG. 2, for moving and rotating the brush. The brush 10 carries closely packed, resilient and flexible strands 11 with at least their radially outer portions 12 impregnated with abrasive particles 13. Preferably, the strands are made by extrusion of epoxy with aluminum oxide and silicon carbide mixed in the epoxy. The control 30 employs a closed loop feedback system 31 which senses torque to regulate the rotation of the brush at constant torque values while the strands are in contact with a surface to be polished. Concurrently, the brush hub 14 is subjected to coolant circulated through tubes 32 from a cooling mechanism 50, to preserve the integrity of the strands. An air/oil mist generator 43 transmits a mist 33 through tubing 42 for injection between the strands to lubricate the abrasive polishing action for more uniform frictional drag.

The brush 10 is comprised of a central hub 14, formed of a solid epoxy composite, with a central metal collet chuck 19 locked to the hub. The hub has apertures 20 extending through the hub for admitting air/oil mist and has internal channels 21 for conducting coolant through the hub.

The strands 11 extend from the hub 14 with one end 15 of each strand embedded and secured therein; the other end 16 of each filament is free to resiliently flex when contacted by the surface to be polished. The strands are preferably formed of uniform diameter (0.02–0.04 inches) stabilized nylon filament, which may have a preformed waviness. The strands are closely packed together, but each strand is independently capable of extreme resilient flexing, but typically about 0.5 inches from its neutral position. The outer strand tip portions 17 are sheared to present an apparent curved surface 18, such as a portion of a sphere (i.e., hemisphere as shown). The density of the strand packing is about 85% within a column of strands and somewhat less between columns, so that in the region of the apparent surface 18, the strands may still lightly touch each other, standing side by side.

At least the outer strand portion 12 (usually about 0.12–2.0 inches) of each strand 11 contains the abrasive particles 13 by a process which consists of impregnating the composition of the strand portion, followed by heating to secure a bond. The abrasive particles are selected from the group consisting of SiC, $Al_2O_3$ and $SiO_2$. Silicon carbide is preferred because of its abrasive qualities (i.e., sharp cornered particles due to crystal structure).

The control apparatus 30, for uniquely rotating the brush 10 in a polishing operation, as shown in FIG. 2, comprises an electric motor 34 with a spindle 35 drivingly connected to the collet chuck 19 of the brush to form a movable assembly 36 carried by a positioner 37 of an NC machining system. A power controller 39 is electrically connected to the motor and positioner by the close-loop feedback system 31 with a torque sensor 40 at the motor. Air/oil mist 33 from a generating assembly 43 is conducted by tubing 42 to apertures 20 in the brush hub to bathe the strands during polishing. Fluid coolant is conducted through tubing 32 to channels 21 in the hub to maintain the strands at or below a desired temperature such as less than 150° F.

Figures 3, 3A:
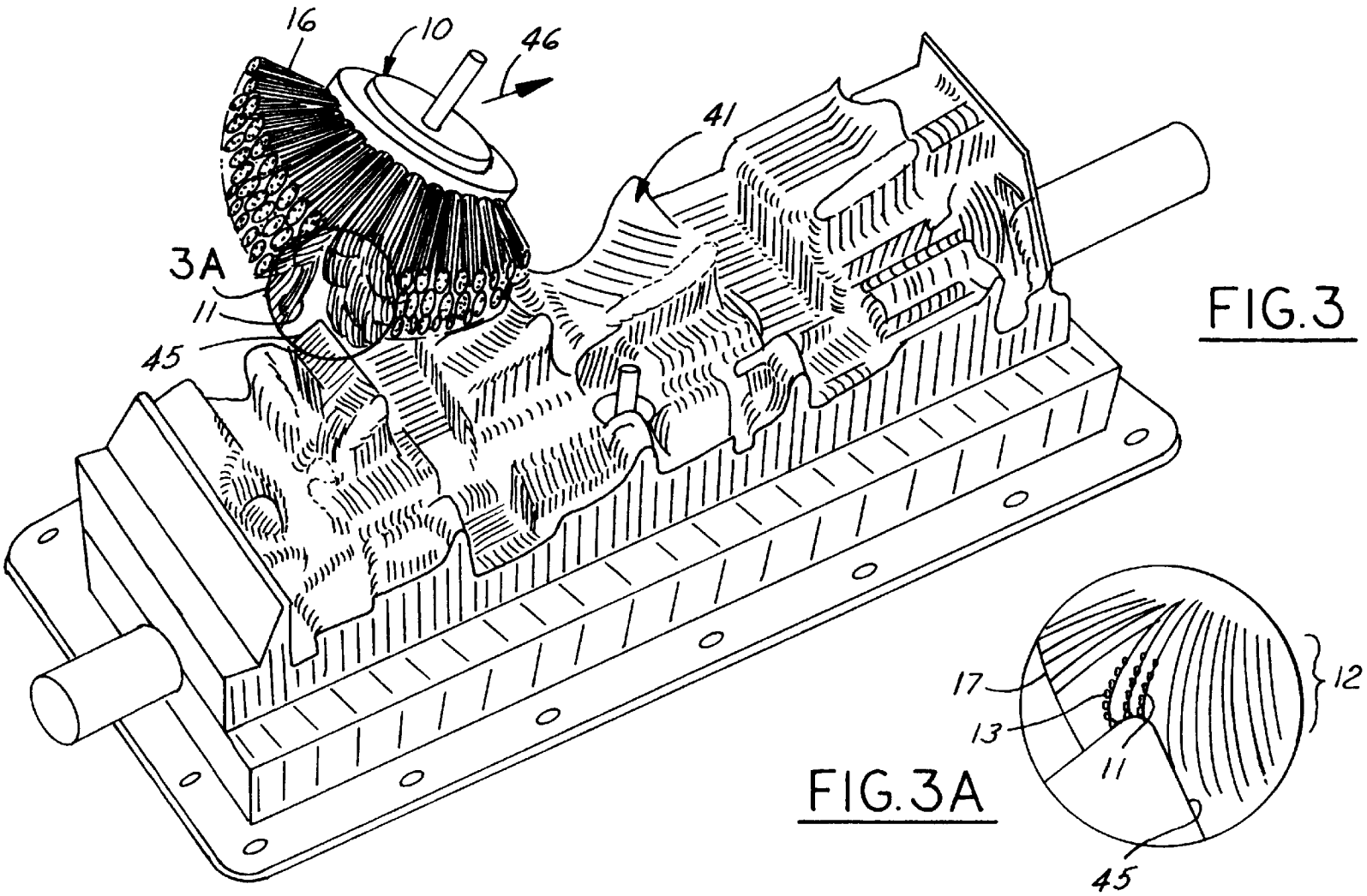
FIG. 3 is a schematic representation of a metal die surface (forming part of a die used to form sand cores for casting an aluminum engine head) being polished by the brush tool of FIG. 1 and depicting the abrading effect.
FIG. 3A is an enlarged view of the circled portion of FIG. 3.

Polishing of a free-form surface 41 is depicted in FIG. 3. Surface 41 is an aluminum die surface machined in a very complex free-form configuration which is needed to form one of several sand cores that are used to mold an automotive engine block or head. Mating die surfaces on other supports (not shown) complete the die for molding the sand, which is usually blown into the die assembly. Note how the closely packed strands flex and drag across surface segments 45 as the assembly 36 is moved linearly along path 46.

Certain features of this invention are important. First, the strands of the brush are rotatingly driven and dragged across the surface 41 at a constant torque promoting uniform metal removal action. Constant torque is maintained by changing the force at which the flexible strands are pressed against the surface. This can be obtained by varying the position of the assembly 36 relative to the surface 41 (moving closer or further away) in response to sensed deviation in the torque of the brush. To reduce torque, moving the assembly away will cause the strands to flex less and press less diligently against the surface 41, reducing frictional drag and thereby the sensed torque. For example, if the desired surface finish is to be 10–15 micrometers (Ra), the assembly 36 is desirably moved at a lineal rate along the surface 41 at about 100–300 millimeters per minute and positioned to exert a normal pressure of about 52 pounds, thus flexing the strands at a perceived torque of about 47 newtons, assuming the brush is powered by a 50 watt motor with the strands having an average radius of about 0.0254 and an average rotational speed of 400 rpm or 42 rad/sec. As the free-form surface 41 changes contours, and thus causing the brush to encounter a change in torque due to an increase or decrease in frictional drag, the sensor 40 immediately causes the assembly 36 to increase its spacing to the surface, thereby reducing drag and restoring the desired constancy of the torque.

Secondly, use of an air/oil mist, as well as a coolant to maintain the temperature of the strands serves to facilitate constant torque and frictional contact at a predetermined temperature, such temperature facilitating breakdown of the abrasive media. This is facilitated because there is removal of cut material (swarf) from the cutting zone as well as removal of grit as breakdown of worn abrasive media; the nylon strands soften at a certain temperature and will thus be able to release worn abrasive particles to thereby expose fresh abrasive particles for more effective cutting.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

What is claimed is:

1. A method of automatic finishing of a free-formed contoured metal or hard die surface, comprising:

(a) providing a rotating brush with a central hub carried by a driving spindle for rotation about the hub axis;

(b) providing said brush hub with a plurality of closely spaced, resilient and flexible free-standing nylon filament strands possessing abrasive polishing particles, said filaments having a uniform diameter in the range of 0.02–0.04 inches, each strand being secured at one end in the hub and having sufficient stiffness in a static condition to have its other end standing radially away therefrom to present an apparent curved surface of closely packed strand ends having their outer extremities in a touching relationship; and (c) rotatingly driving said hub and strands at a constant torque in the range of 40–60 newtons while dragging the ends of said strands across said die surface, while in contact with such surface to effect the desired degree of polishing, said hub being driven by an electric motor carried on a computer positioned assembly, and wherein a closed loop feedback central, in connection with the motor and assembly, causes the assembly to move in response to sensed torque of the brush for restoring the torque to a constant value, the attainment of constant torque being achieved by modulating the output torque of the electric motor spindle rotatingly driving said brush and by raising or lowering the brush relative to said surface.

2. The method as in claim 1, in which said abrasive polishing particles are selected from the group consisting of silicon carbide, aluminum oxide and silicon oxide.

3. The method as in claim 1, in which said abrasive polishing particles are imprenagted into said strands.

4. The method as in claim 1, in which the brush is rotatingly moved linearly along said surface to be polished while said strands are in contact therewith at a linear traverse rate of about 100–300 mm per minute.

5. The method as in claim 1, in which the density of said body of strands is about 85%.

6. The method as in claim 4, in which said abrasive particles constitute about 10–15 volume % of said body of strands and develop a dry coefficient of friction with said surface of about 0.2.

7. The method as in claim 1, in which step (c) is carried out to attain an average surface roughness on the surface being polished of about 10–15 micrometers (Ra).

8. The method as in claim 1, in which the coated abrasive polishing particles are selected in the grain size range of 70–100 grit.

* * * * *